US005379859A

United States Patent [19]

Pigman

[11] Patent Number: 5,379,859

[45] Date of Patent: Jan. 10, 1995

[54] ADJUSTABLE ROOF SCAFFOLD SUPPORT ASSEMBLY

[76] Inventor: Steven O. Pigman, 1315 Bonacker Ave., Hamilton, Ohio 45011

[21] Appl. No.: 79,402

[22] Filed: Jun. 21, 1993

[51] Int. Cl.[6] ..... E04G 27/00

[52] U.S. Cl. ..... 182/45; 248/237

[58] Field of Search ..... 182/45, 82, 152; 248/237

[56] References Cited

U.S. PATENT DOCUMENTS

| | | | |
|---|---|---|---|
| 15,390 | 7/1856 | Rodefer | 248/237 |
| 201,691 | 3/1878 | McClelland | 248/237 |
| 1,646,923 | 10/1927 | Martens | 248/237 |
| 1,803,788 | 5/1931 | Brown | 248/237 |
| 2,299,323 | 10/1942 | Hetky | 248/237 |
| 2,840,424 | 6/1958 | Broderick | 182/45 |
| 2,888,225 | 5/1959 | McQuin | 182/45 |
| 4,856,745 | 8/1989 | Mabie | 248/237 |
| 4,884,775 | 12/1989 | Fischer, Jr. | 248/237 |
| 4,946,123 | 8/1990 | Albert | 182/45 X |
| 5,067,586 | 11/1991 | Myers | 248/237 |

FOREIGN PATENT DOCUMENTS

| | | | |
|---|---|---|---|
| 508028 | 9/1930 | Germany | 182/45 |

*Primary Examiner*—Alvin C. Chin-Shue

[57] ABSTRACT

A scaffold support assembly comprises a support subassembly, a brace subassembly and a position adjustment subassembly. The support subassembly includes a longitudinal base member and a stabilizer member attached in transverse relation to and extending in opposite directions laterally from the longitudinal base member. Both the base and stabilizer members are adapted to lie flat on the roof. The brace subassembly includes vertical and horizontal members and an elongated flexible member. The vertical and horizontal members are connected at adjacent ends to the base member and pivotally movable relative thereto. The elongated flexible member extends between and interconnects remote ends of the vertical and horizontal members such that the elongated flexible member and vertical and horizontal members are arranged in a right trianglar-shaped configuration. The position adjustment subassembly includes a brace, a bracket, and a fastening element. The brace is rigidly attached to the base member. The bracket is attached on the brace and has a plurality of arcuately displaced apertures defining different positions of adjustment for the vertical member. The fastening element releasably connects the vertical member with the bracket so as to dispose the vertical member at a selected one arcuately displaced position which accommodates the roof pitch so as to maintain the horizontal member in a horizontal plane.

18 Claims, 2 Drawing Sheets

ADJUSTABLE ROOF SCAFFOLD SUPPORT ASSEMBLY

BACKGROUND OF THE INVENTION

1. Field of the Invention

The present invention generally relates to roof scaffolding apparatus and, more particularly, is concerned with an adjustable roof scaffold support assembly.

2. Description of the Prior Art

As is well known, most roof surfaces generally are sufficiently steep that roofers, who must move about thereon for a variety of reasons, must be continuously alert to the danger of slipping and falling. Over the years, many roof scaffold devices have been proposed in the prior art to reduce these dangers. Representative examples of such prior art devices are disclosed in U.S. Patents to Rodefer (U.S. Pat. No. 15,390), Martens (U.S. Pat. No. 1,646,923), Brown (U.S. Pat. No. 1,803,788), Hetky (U.S. Pat. No. 2,299,323), Broderick (U.S. Pat. No. 2,840,424), McQuin (U.S. Pat. No. 2,888,225), Mabie (U.S. Pat. No. 4,856,745), Fischer, Jr. (U.S. Pat. No. 4,884,775) and Myers (U.S. Pat. No. 5,067,586).

However, a steep roof presents several problems for roofers which do not appear to be adequately addressed by these prior art devices. One problem is that roofers are not able to conveniently install and remove a scaffold in a safe manner on and from the bottom of the roof. Another problem is that roofers are not able to install the scaffold at correct proximity from the roof edge so that the scaffold does not block the area of the roof to be covered. Still another problem is that roofers are not able to maintain a level surface for the scaffold to rest upon. These are particularly pertinent problems on very steep roofs.

Consequently, a need still exists for a roof scaffold device which adequately addresses the problems of steep roofs.

SUMMARY OF THE INVENTION

The present invention provides an adjustable roof scaffold support assembly designed to satisfy the aforementioned needs. The adjustable roof scaffold support assembly of the present invention employs only a few conventional nails to quickly install and remove the scafford support assembly from the trusses of the roof structure. The scaffold support assembly distributes the weight of the load throughout its frame structure, thereby providing it with more than ample strength.

Also, the scaffold support assembly can be placed at the bottom of the trusses such that the load platform member can extend well past the roof edge. Then, a scaffold can be placed across the load platform member to give access to the bottom portion of the roof to a degree not possible with other roof scaffold devices. The scaffold support assembly can be moved and used progressively from the lower edge to the upper peak of the roof.

Further, by employing a bracket above the load platform to define arcuately displaced positions, a position adjustment subassembly of the scaffold support assembly is thereby provided with a range which will maintain a level platform from a 7/12 to a mansard pitch. Also, the scaffold support assembly utilizes a brace subassembly of high tensile strength to support the load platform.

Accordingly, the present invention is directed to an adjustable roof scaffold support assembly which comprises: (a) first means for defining a load platform adapted to support an elongated scaffold member; (b) second means for attaching the first means on a pitched roof such that the load platform can extend outwardly from an edge of the roof; and (c) third means supported by the second means for defining a plurality of arcuately displaced positions and for releasably connecting with the first means so as to dispose the first means at a selected one of the arcuately displaced positions which accommodates the pitch of the roof so as to maintain the load platform of the first means in a substantially horizontal plane. The first means is a support subassembly. The second means is a brace subassembly. The third means is a position adjustment subassembly.

More particularly, the support subassembly includes a longitudinal base member and a transverse stabilizer member attached in transverse relation to and extending in opposite directions laterally from a lower end portion of the longitudinal base member. Both the longitudinal base member and transverse stabilizer member are adapted to lie substantially flat on the roof.

The brace subassembly includes a vertical adjustment member, a horizontal load platform-defining member, and an elongated flexible member. The vertical adjustment member and horizontal load platform-defining member are connected at adjacent ends to the longitudinal base member and pivotally movable relative thereto. The elongated flexible member extends between and interconnects remote ends of the vertical adjustment member and horizontal load platform-defining member such that the elongated flexible member and vertical and horizontal members are arranged in a substantially right trianglar-shaped configuration.

The position adjustment subassembly includes an upright bracket and a fastening element. The bracket is rigidly attached upright to the longitudinal base member of the support assembly. The bracket has a plurality of arcuately displaced apertures formed therethrough which define the different positions of adjustment for the vertical adjustment member of the brace subassembly. The fastening element releasably connects the vertical adjustment member of the brace subassembly with the bracket so as to dispose the vertical adjustment member at the selected one of the arcuately displaced positions which accommodates the particular pitch of the roof so as to maintain the horizontal load platform-defining member in the substantially horizontal plane.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
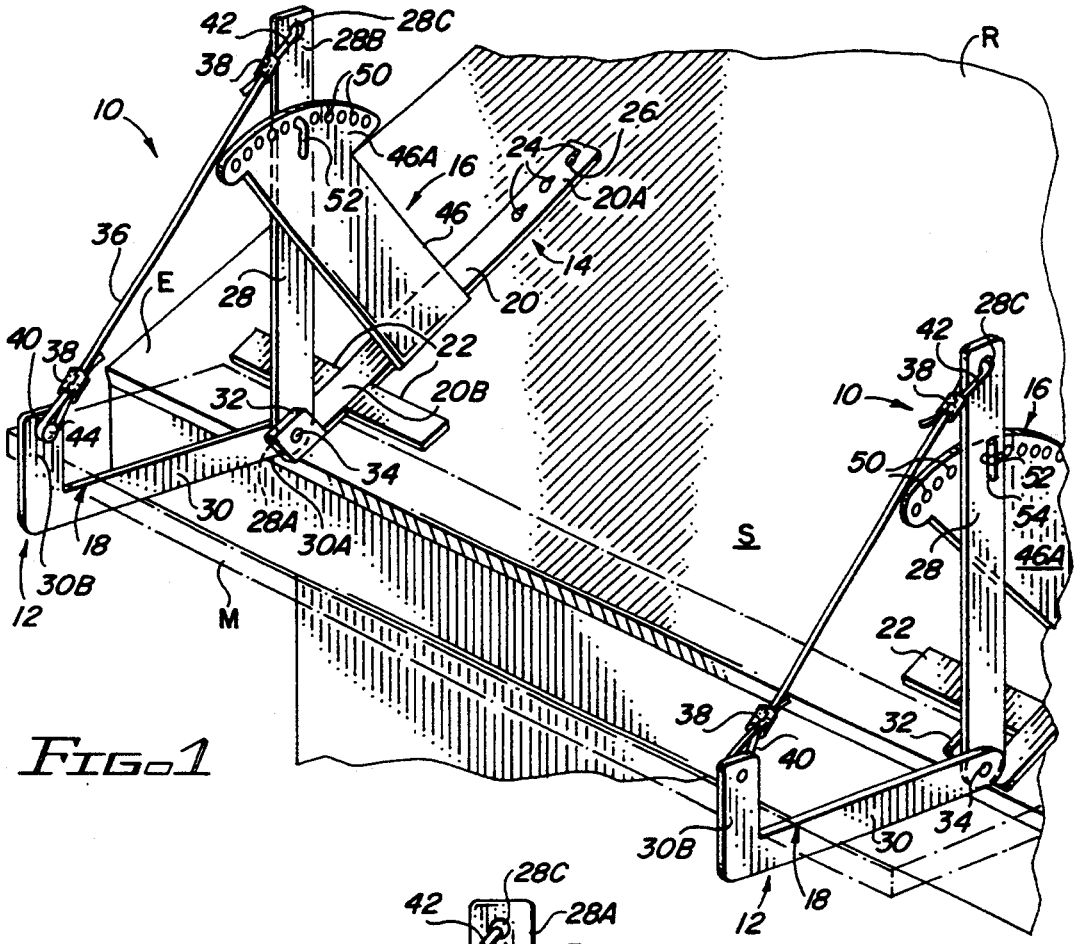
FIG. 1 is a perspective view of a pair of adjustable roof scaffold support assemblies of the present invention installed at a roof edge such that the scaffold extends past the roof edge.
Figure 2:
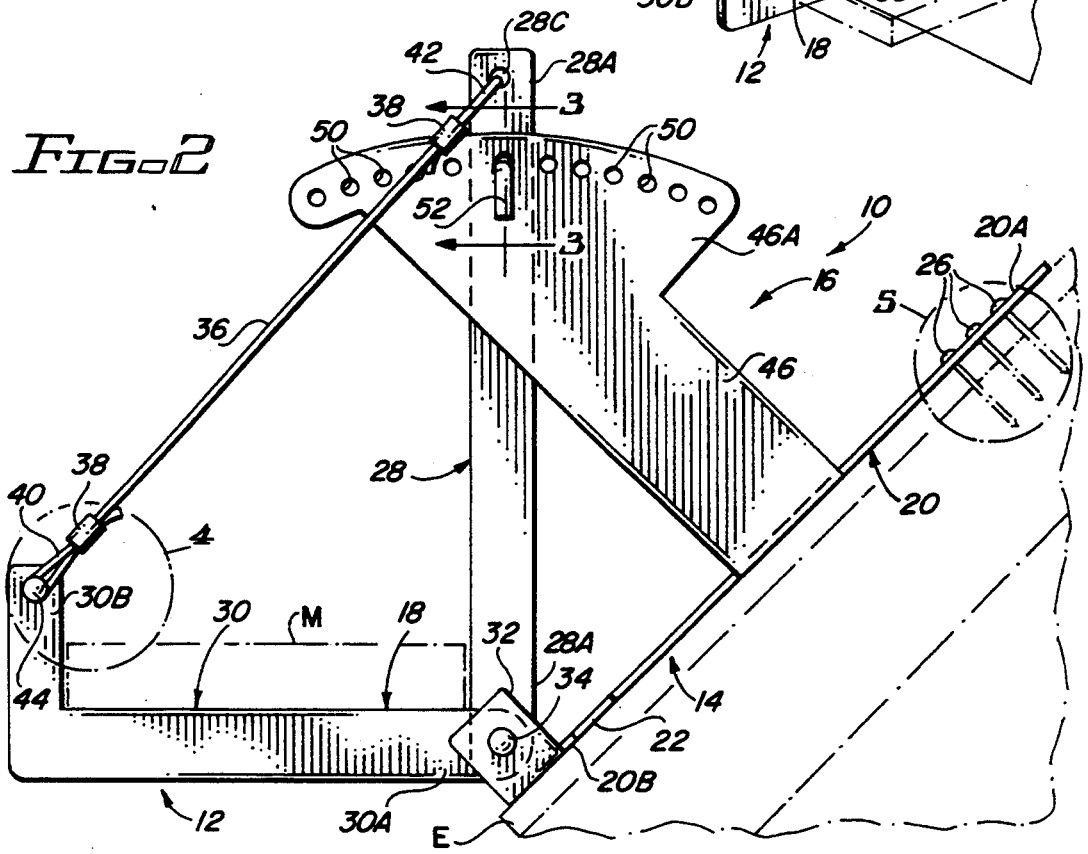
FIG. 2 is a side elevational view of one of the scaffold support assemblies of FIG. 1.

Referring to the drawings and particularly to FIGS. 1 and 2, there is illustrated a pair of adjustable roof scaffold support assemblies, generally designated 10, constructed in accordance with the principles of the present invention. The scaffold support assemblies 10 are shown installed on a bottom portion of a pitched roof R in laterally spaced relation to one another such that an elongated scaffold member M supported by the scaffold support assemblies 10 extends outwardly from a lower edge E of the pitched roof R.

Basically, each scaffold support assembly 10 comprises first means in the form of a brace subassembly 12, second means in the form of a support subassembly 14, and third means in the form of a position adjustment subassembly 16. The brace subassembly 12 defines a load platform 18 adapted to support the elongated scaffold member M. The support subassembly 14 is mounted on a surface S of the pitched roof R and, in turn, attaches the brace subassembly 12 on the pitched roof R such that its load platform 18 can extend outwardly from the roof edge E when the scaffold support assembly 10 is mounted at the bottom portion of the roof R. The position adjustment subassembly 16 is supported upright by the support subassembly 14 and is releasably connected with the brace subassembly 12. In such manner, the position adjustment subassembly 16 disposes the brace subassembly 12 at a selected one of a plurality of arcuately displaced positions defined by the position adjustment subassembly 16 which will accommodate the pitch of the roof R so as to maintain the load platform 18 of the brace subassembly 12 and the scaffold member M disposed thereon in a substantially horizontal plane, as seen in FIGS. 1 and 2.

Figure 5:
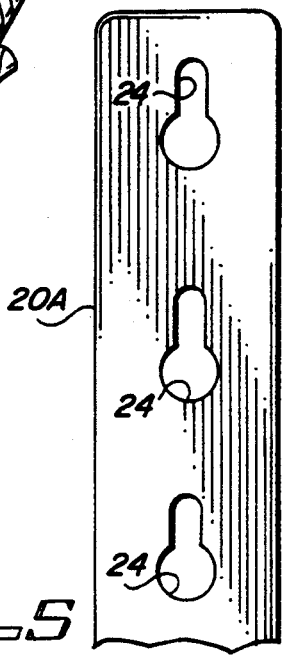
FIG. 5 is an enlarged detailed plan view of the portion of the scaffold support assembly enclosed by circle 5 of FIG. 2.

Referring to FIGS. 1, 2, 6 and 7, the support subassembly 14 of the scaffold support assembly 10 includes a generally flat longitudinal base member 20 and a generally flat transverse stabilizer member 22. The elongated flat configurations of the longitudinal base member 20 and transverse stabilizer member 22 adapt them to lie substantially flat on the surface S of the pitched roof R. The longitudinal base member 20 has spaced upper and lower end portions 20A, 20B. As seen in FIGS. 1 and 5, the upper end portion 20A of the longitudinal base member 20 has a plurality of key-hole spaced openings 24 defined therethrough for receiving attaching elements 26, such as conventional sixteen penny nails, in order to attach the support subassembly 14 on the surface S of the roof R. The flat transverse stabilizer member 22 is attached to and extends in opposite directions laterally from the lower end portion 20B of the longitudinal base member 20. Given such configuration, the support subassembly 14 positions the brace subassembly 12 and position adjustment subassembly 16 in a generally vertical plane and prevents them from tilting sideways away from the vertical plane.

Referring still to FIGS. 1, 2, 6 and 7, the brace subassembly 12 of the scaffold support assembly 10 includes a vertical adjustment member 28 and a horizontal load platform-defining member 30. The vertical and horizontal members 28, 30 respectively have spaced opposite ends 28A, 28B and 30A, 30B. The vertical and horizontal members 28, 30 are pivotally connected to one another at their adjacent ends 28A, 30A and pivotally connected to the lower end portion 20B of the longitudinal base member 20 of the support subassembly 14. More specifically, a tab 32 is fixed upon the lower end portion 20B of the longitudinal base member 20 below the transverse stabilizer member 22 and is pivotally connected to the vertical and horizontal members 28, 30 via a pivot pin 34 extending through aligned holes (not shown) in the tab 32 and adjacently disposed ends 28A, 30A of the vertical and horizontal members 28, 30.

As seen in FIGS. 1, 2, 4, 6 and 7, the brace subassembly 12 also includes an elongated flexible member 36 in the form of a flexible cable 36 extending between and interconnecting remotely disposed ends 28B, 30B of the vertical and horizontal members 28, 30. The opposite ends of the flexible cable 36 are folded back upon themselves and encircled by respective annular connectors 38 to provide the opposite ends in the form of lower and upper loops 40, 42. The outer remote end 30B of the horizontal member 30 is upturned so as to confine the scaffold member M on the upper surface of the horizontal member 30. The lower end loop 40 of the flexible cable 36 extends about an anchor pin 44 fixed on the upturned outer end 30B of the horizontal member 30. As seen in FIGS. 1, 2, 6 and 7, such arrangement of the vertical adjustment member 28, horizontal load platform-defining member 30 and elongated flexible cable 36 of the brace subassembly 12 provide them in a substantially right triangular-shaped.

Referring to FIGS. 1, 2, 3, 6 and 7, the position adjustment subassembly 16 of the scaffold support assembly 10 includes a bracket 46 and a fastening or securing element 48. The bracket 46 is rigidly attached to an edge of the flat longitudinal base member 20 of the support subassembly 14 at a location spaced from and between the transverse stabilizer member 22 and the openings 24 in the upper end portion 20A of the longitudinal base member 20. The bracket 46 extends upright from the longitudinal base member 20 and has a plurality of arcuately spaced apertures 50 defined therethrough on an upper end portion 46A of the bracket 46. The apertures 50 define a plurality of arcuately displaced positions at which the vertical adjustment member 28 of the brace subassembly 12 can be placed. The upper loop 42 of the flexible cable 36 is inserted through a hole 28C in the upper end 28B of the vertical member 28.

Figure 3:
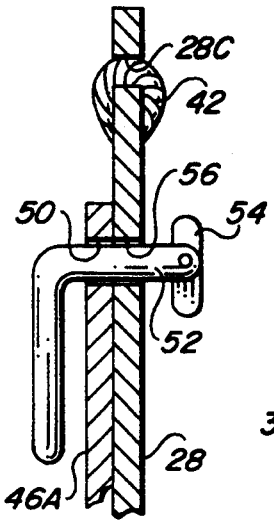
FIG. 3 is an enlarged fragmentary sectional view taken along line 3—3 of FIG. 2.
Figure 4:
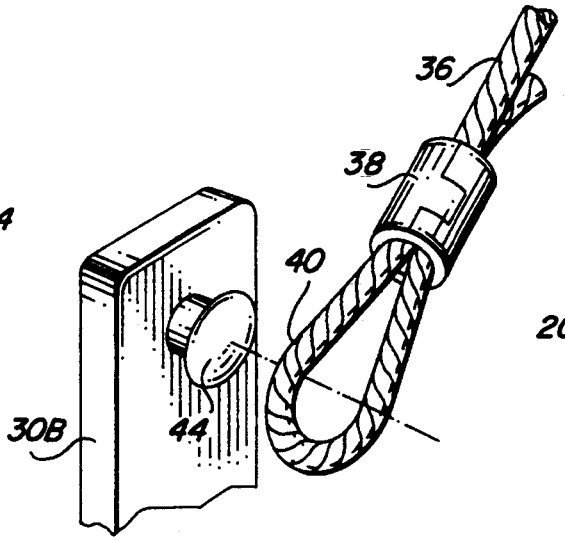
FIG. 4 is an enlarged detailed perspective view of the portion of the scaffold support assemby enclosed by circle 4 of FIG. 2.

As seen in FIG. 3, the fastening element 48 can take the form of the right angle lock pin 52 with the pivotal latch 54 mounted at an end thereof which. With the latch 54 rotated parallel to its portion mounting the latch, the lock pin 52 can be inserted through and removed from a selected one of the apertures 50 in the bracket 46 and a single hole 56 defined through the vertical adjustment member 28 of the brace subassembly 12 being aligned with the one aperture.

Figure 6:
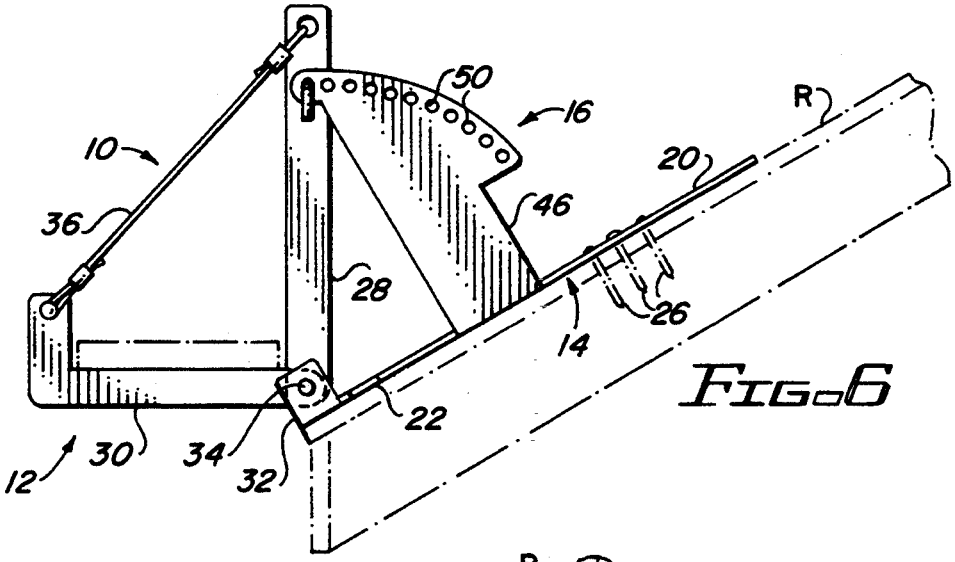
FIG. 6 is a reduced side elevational view of the scaffold support assembly shown adjusted to one of a pair of limit positions for use on a relatively shallow roof.
Figure 7:
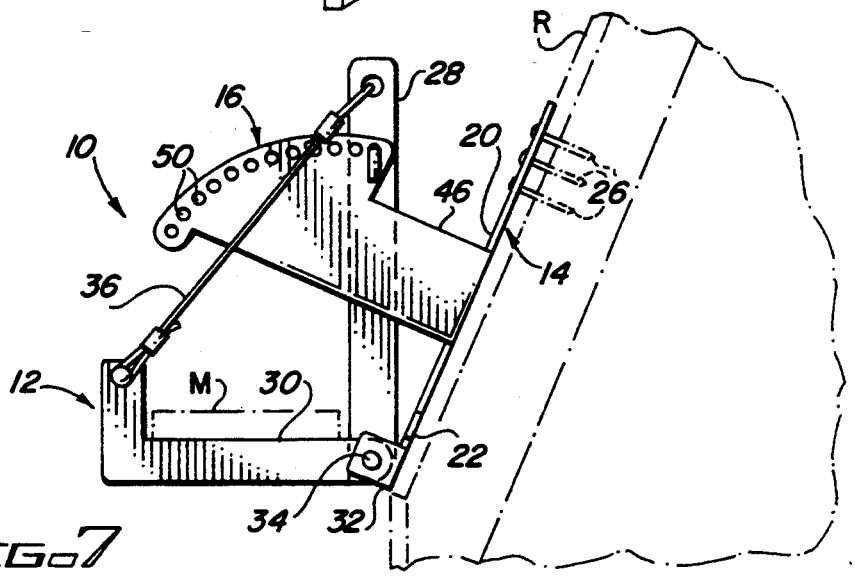
FIG. 7 is a view similar to that of FIG. 6 but showing the scaffold support assembly adjusted to the other of the pair of limit positions for use on a relatively steep roof.

Thus, the lock pin 52 is adapted to releasably connect the vertical adjustment member 28 of the brace subassembly 12 with the upright bracket 46 of the position adjustment subassembly 16 so as to to dispose the vertical adjustment member 28 of the brace subassembly 12 at a selected one of the arcuately displaced positions between the opposite limits seen in FIGS. 6 and 7 which accommodates the particular pitch of the roof R on which the scaffold support assembly 10 is being applied on, so as to thereby maintain the horizontal load platform-defining member 30 of the brace subassembly 12 in the substantially horizontal plane.

From the above description of the construction of the scaffold support assembly 10, it is readily realized that the scaffold support assembly 10 can be quickly and easily setup to the correct angular position and removed in order to be placed at another position. Also, the construction of the scaffold support assembly 10 distributes the weight of the load substantially evenly throughout its structure, providing more than ample strength to support the anticipated load.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. An adjustable roof scaffold support assembly, comprising:

(a) first means for defining a load platform adapted to support an elongated scaffold member;

(b) second means, generally flat having spaced upper and lower end portions, for attaching said first means on a surface of a pitched roof, said first means being pivotally connected to said second means at said lower end portion such that said load platform can extend outwardly from an edge of the roof; wherein said first means is a brace subassembly which includes: a vertical adjustment member; and a horizontal member defining said load platform, said vertical adjustment member and said horizontal load platform-defining member being movably connected at adjacent ends to said second means; and (c) Third means supported by said second means defining a plurality of arcuately displaced positions and releasably connected to said vertical adjustment member so as to dispose said first means at a selected one of said arcuately displaced positions which accommodates the pitch of the roof so as to maintain said load platform of said first means in a substantially horizontal plane.

2. The assembly of claim 1 wherein said second means is a support subassembly which comprises:

a longitudinal base member being adapted to lie on a surface of the roof surface; and a stabilizer member attached in transverse relation to and extending in opposite directions laterally from said lower end portion.

3. The assembly of claim 2 wherein said upper end portion has a plurality of spaced openings defined therethrough for receiving attaching elements to attach said support subassembly on the surface of the roof.

4. The assembly of claim 2 wherein said longitudinal base member and said stabilizer member have substantially flat elongated configurations adapting them to lie substantially flat on the roof surface.

5. The assembly of claim 2 wherein said first means is a brace subassembly which includes:

a vertical adjustment member; and a horizontal member defining said load platform, said vertical adjustment member and said horizontal load platform-defining member being movably connected at adjacent ends to said lower end portion of said second means.

6. The assembly of claim 5 wherein said brace subassembly also includes an elongated member extending between and interconnecting remote ends of said vertical adjustment member and said horizontal load platform member such that said elongated member, vertical adjustment member, and horizontal load platform-defining member of said bracing structure have a substantially right triangular-shaped configuration.

7. The assembly of claim 6 wherein said elongated member is a flexible cable.

8. The assembly of claim 2 wherein said third means is a position adjustment subassembly which includes:

a bracket attached to said second means and extending upright therefrom, said bracket having means for defining said plurality of arcuately displaced positions; and a fastening element adapted to releasably connect said first load platform-defining means with said bracket so as to dispose said first load platform-defining means at a selected one of said arcuately displaced positions which accommodates the pitch of the roof so as to maintain said first load platform-defining means in the substantially horizontal plane.

9. The assembly of claim 8 wherein said plurality of arcuately displaced positions is defined by a plurality of arcuately displaced apertures.

10. The assembly of claim 1 wherein said brace subassembly also includes an elongated member extending between and interconnecting remote ends of said vertical adjustment member and said horizontal load platform member such that said elongated member, vertical adjustment member, and horizontal load platform-defining member of said bracing structure have a substantially right triangular-shaped configuration.

11. The assembly of claim 10 wherein said elongated member is a flexible cable.

12. The assembly of claim 1 wherein said third means is a position adjustment subassembly which includes:

a bracket attached to said second means and extending upright therefrom, said bracket having means for defining said plurality of arcuately displaced positions; and a fastening element adapted to releasably connect said first load platform-defining means with said bracket so as to dispose said first load platform-defining means at the selected one of said arcuately displaced positions which accommodates the pitch of the roof so as to maintain said load platform defining means in the substantially horizontal plane.

13. An adjustable roof scaffold support assembly, comprising:

(a) a support subassembly including a longitudinal base member having spaced upper and lower end portions and being adapted to lie on a surface of the roof surface, and a stabilizer member attached in transverse relation to and extending in opposite directions laterally from said lower end portion of said longitudinal base member;

(b) a brace subassembly including a vertical adjustment member and a horizontal load platform-defining member respectively having spaced opposite ends and being connected to said lower end portion of said longitudinal member and together at adjacently disposed ones of said opposite ends, said brace subassembly also including an elongated member extending between and interconnecting remotely disposed ones of said opposite ends of said vertical adjustment member and said horizontal load platform member such that said elongated member, vertical adjustment member, and horizontal load platform member of said bracing structure have a substantially right triangular-shaped configuration; and (c) a position adjust subassembly including a bracket attached to said longitudinal member of said base and extending upright therefrom and having means defining a plurality of arcuately displaced positions, and a fastening element adapted to releasably interconnect said vertical adjustment member of said bracing structure with said bracket of said adjustment member so as to dispose said vertical adjustment member at a selected one arcuately displaced position which accommodates the pitch of the roof so as to maintain the horizontal load platform member in a substantially horizontal plane.

14. The assembly of claim 13 wherein said upper end portion of said longitudinal base member has a plurality of spaced openings defined therethrough for receiving attaching elements to attach said support subassembly on the surface of the roof.

15. The assembly of claim 13 wherein said longitudinal base member and said stabilizer member have substantially flat elongated configurations adapting them to lie substantially flat on the roof surface.

16. The assembly of claim 13 wherein said plurality of arcuately displaced positions is defined by a plurality of arcuately displaced apertures.

17. The assembly of claim 13 wherein said elongated member is a flexible cable.

18. An adjustable roof scaffold support assembly, comprising:

(a) a support subassembly including a flat longitudinal member adapted to lie substantially flat on a roof surface and having spaced upper and lower end portions, said base also including a flat stabilizer member attached in transverse relation to and extending in opposite directions laterally from said lower end portion of said longitudinal base member, said flat stabilizer member being adapted to lie substantially flat on the roof surface;

(b) a brace subassembly including a vertical adjustment member and a horizontal load platform-defining member respectively having spaced opposite ends and being connected at adjacently disposed ones of said opposite ends to said lower end portion of said longitudinal base member of said support subassembly, said brace subassembly also including an elongated flexible member extending between and interconnecting remotely disposed ones of said opposite ends of said vertical adjustment member and said horizontal load platform member such that said elongated flexible member, vertical adjustment member, and horizontal load platform member of said bracing structure have a substantially right triangular-shaped configuration; and (c) a position adjustment subassembly including a bracket attached to said longitudinal base member of said support subassembly and extending upright therefrom and a plurality of apertures defined through an upper end of said bracket defining a plurality of arcuately displaced positions, said position adjustment subassembly also including a fastening element adapted to releasably connect said vertical adjustment member of said bracing subassembly with said bracket so as to dispose said vertical adjustment member at a selected one of said arcuately displaced positions which accommodates the roof pitch so as to maintain the horizontal load platform member in a substantially horizontal plane.

* * * * *